United States Patent [19]

Tout et al.

[11] Patent Number: 4,509,271

[45] Date of Patent: Apr. 9, 1985

[54] TREATMENT OF ARTICLES HAVING A COATING OF A MOISTURE-CURABLE COMPOSITION

[75] Inventors: Nigel R. Tout, Leicester; Raymond Hanson, Rearsby, both of England

[73] Assignee: USM Corporation, Farmington, Conn.

[21] Appl. No.: 439,279

[22] Filed: Nov. 4, 1982

[30] Foreign Application Priority Data

Nov. 14, 1981 [GB] United Kingdom ..... 8134392
Oct. 21, 1982 [GB] United Kingdom ..... 8230200

[51] Int. Cl.[3] ..... F26B 3/04

[52] U.S. Cl. ..... 34/12; 34/26; 34/46; 34/202; 34/68; 34/39

[58] Field of Search ..... 34/202, 195, 198, 1, 34/4, 39, 68, 12, 26, 28, 30, 36, 46, 48; 118/641, 642, 643

[56] References Cited

U.S. PATENT DOCUMENTS 1,925,210 9/1933 Smith ..... 34/198
2,758,387 8/1956 Stann ..... 34/195
3,718,082 2/1973 Lipoma ..... 99/470

FOREIGN PATENT DOCUMENTS 1540634 2/1979 United Kingdom .

*Primary Examiner*—Larry I. Schwartz
*Attorney, Agent, or Firm*—Donald N. Halgren

[57] ABSTRACT

A method of treating shoe parts having a coating of a moisture-curable composition utilizes an apparatus in which a support (16) for an article, e.g. a lasted shoe S, can be supported within a chamber (30) in which the support can be enclosed. The chamber (30) is supplied with heat and moisture. More especially, the article is subjected to infra-red radiation from a heater (44) and steam is supplied to the chamber (30) such that the humidity of the atmosphere within the chamber (30) is maintained during the operating cycle at a dew point of between 50° and 60° C. The surface temperature of the heater (44) is between 250° and 420° C., preferably between 300° and 380° C., and the article is subjected to infra-red radiation for a period of between 5 and 25 seconds, preferably 10 seconds. Because the chamber (30) is enclosed, steam is supplied for only the first 5 seconds of the heating period.

8 Claims, 2 Drawing Figures

54
S
18
16
26
40
42
54
24
26
38
52
10
12
44
50
14
28
36
S
18
16
20
22
24
52
62
34
46
60
32
64
48

TREATMENT OF ARTICLES HAVING A COATING OF A MOISTURE-CURABLE COMPOSITION

BACKGROUND OF THE INVENTION (1) Field of the Invention

This invention is concerned with the treatment of articles, e.g. shoe parts, having a coating of a moisture-curable composition, more particularly an apparatus for the treatment of such articles comprising a support for an article to be treated, a chamber for receiving the support, an article treatment means for supplying heat and moisture to the chamber thus to treat an article supported therein.

(2) Prior Art

Apparatus for the treatment of articles other than shoe parts, e.g. printed material, are known, such apparatus usually comprising a chamber in the form of a tunnel through which an article supported on a support can be progressively moved, heat and moisture being supplied to the chamber. Such an apparatus is customarily connected to a printing machine by means of a feed device which feeds printed articles successively into the chamber, the articles then passing through the chamber at a relatively slow rate and being treated during such passage. Because of the successive presentation of articles automatically, usually the tunnel is open at both ends and the article treatment means is located along a central part of the tunnel.

Apparatus for the treatment of shoe parts (but not having a coating of a moisture-curable composition) of the aforementioned type is also well known, namely so-called heat setting apparatus, in which shoes on lasts are passed progressively through a tunnel and subjected to heat and moisture during such passage so that the shoe upper is caused to conform to the shape of the last and to retain such form in the finished shoe. Again, the passage of the articles through the tunnel is relatively slow.

There has been proposed in U.K. Patent Specification No. 1540634 a method of bonding a shoe sole to a shoe upper using selected urethane prepolymer compositions which are provided as fluid compositions and which are convertible, by a chain extension treatment (by curing), to a polyurethane which, when heated, is tacky and capable of establishing a substantially immediate strong adhesive union with a compatible adhesive or resin surface. The curing of the composition preferably takes place by the application of heat and moisture. More recently, furthermore, an adhesive suitable for use in carrying out such a method, and identified as "Bostik PA 5102" ("Bostik" is a Registered Trade Mark), has become available.

In carrying out such a method, however, in the manufacture of shoes, it is desirable that the curing of the composition takes place relatively rapidly. This is beneficial not only in that the space requirement for a machine through which the shoe parts progress slowly is relatively large, but also in that the slower the curing process, the greater the number of parts which at any given time are in the course of curing, with consequent disadvantages, e.g. in the use of labour towards the end of a working shift and also problems of storing coated parts between shifts. Consequently, the known type of apparatus referred to above cannot satisfactorily be used.

Furthermore, in the known apparatus referred to above, no further operation is contingent upon the particular treatment step carried out in such apparatus. Thus, in the case of printed material, once it is dried it constitutes the finished product, and similarly in the case of a heat setting apparatus no further shoe-making operation is dependent upon the degree of heat set produced. Thus, the conditions of operation of such apparatus, for the purpose of which they are intended, need not be controlled with any significant restrictions, other than perhaps those dictated by the economics of the operation, in terms of space and energy costs, and in terms of work flow. In the case of an adhesive composition of the type referred to, however, it will be appreciated that two separate but inter-related processes are used in achieving a satisfactory bond, viz. curing and re-activation, and therefore close control is necessary especially during the first stage of the conversion, viz. during curing. The known apparatus referred to is not suitable for achieving such close control.

It is the object of the present invention to provide an apparatus for use in the treatment of articles, e.g. shoe parts, having a coating of a moisture-curable composition, in the operation of which apparatus such coatings can be cured under strictly controlled conditions and at a relatively high rate which is compatible with the flow of work through a factory without giving rise to excessive space demands or storage problems.

BRIEF SUMMARY OF THE INVENTION

With this object in mind, the invention provides, in one of its aspects, apparatus for the treatment of articles, e.g. shoe parts, having a coating of a moisture-curable composition, the apparatus comprising a support for an article to be treated, a chamber for receiving the support, and article treatment means for supplying heat and moisture to the chamber thus to treat an article supported therein, characterised in that, during the treatment of an article, the support is enclosed within the chamber, in that the article treatment means comprises means for subjecting such article to infra-red radiation and for supplying steam within the chamber, and in that control means is provided for controlling (i) the amount of steam supplied in a cycle of operation; (ii) the intensity of the infra-red radiation; (iii) the time period during which the article is subjected to infra-red radiation; and (iv) the time period during which the steam is supplied.

It will thus be apparent that in using the apparatus in accordance with the invention, first the article to be treated is enclosed within a controlled atmosphere for a controlled period of time and is subjected therein to controlled heating. In this way, the amount of cure of the composition during such treatment can also be controlled, and further the timing of the curing process can be tied in with the flow of work to and from the apparatus, so that an efficient use of labour can be achieved, while at the same time ensuring that the curing is effected economically.

Preferably in the apparatus in accordance with the invention the support is movable between a loading/unloading position and an operative position, in which it is received within the chamber. Furthermore, for providing an enclosed atmosphere, preferably the support carries a screen by which, when the support is in its operative position, the chamber is closed. In addition, conveniently the support also carries a further screen by which, when the support is in its loading/unloading position, the chamber is also closed. This is effective firstly to protect the operator from stray radiation while the support is in its loading/unloading position, and furthermore the further screen serves to assist in the evacuation of steam from the chamber, at the end of a cycle of operation, by "sweeping" the steam out into the ambient atmosphere. In this way, the formation of condensation within the chamber is eliminated or at least reduced sufficiently so as not to be detrimental; in this regard, it will be appreciated that any condensation on parts of the apparatus which may contact e.g. a shoe upper can lead to staining of such upper.

The article treatment means preferably comprises a plate heater which is accommodated within the chamber and by which an article support in the chamber is subjected to infra-red radiation. In order to achieve a high efficiency with such heater, the radiating surface thereof is preferably black. In addition, the article treatment means also preferably comprises spraying means whereby a mist of water can be sprayed onto the plate heater for the generation of steam within the chamber. Thus, the heater serves for the irradiation of articles with infra-red radiation, and also for the generation of steam within the chamber. Conveniently, the spraying means comprises one or more nozzles directed towards an impingement surface of the plate heater, impingement of the mist against said surface causing the mist to be converted to steam and such steam to be distributed throughout the chamber. In this way, an atmosphere of uniform humidity can be created within the chamber.

The invention also provides, in another of its several aspects, a method of treating an article, e.g. a shoe part, having a coating of a moisture-curable composition, conveniently using an apparatus as set out above, the method being characterised in that the article is supported in an enclosed chamber for a period of between 5 and 25 seconds, during which period the article is subjected to infra-red radiation from a radiant source having a surface temperature of between 420° and 250° C. and a quantity of steam is supplied to the chamber such that during said period the humidity of the atmosphere within the chamber is maintained at a dew point of between 50° and 60° C.

More particularly, and in accordance with one embodiment of the invention, the period during which the article is subjected to infra-red radiation as aforesaid is of the order of 10 seconds, and the surface temperature of the radiant source is between 300° and 380° C. Furthermore, preferably steam is applied to the chamber for a period of the order of 5 seconds starting contemporaneously with the first-mentioned period. The period of 10 seconds is such that an operator has sufficient time to place the article, the coating on which has just been cured, on a suitable support, e.g. a rack, to remove an article to be coated from a rack and to apply the coating to such article in readiness for the next curing cycle. It will of course be appreciated that, for achieving temperatures within the range referred to, it is necessary to utilize an infra-red radiator. Futhermore, the use of such a radiator in the range of temperatures referred to is such as to reduce the variability in the heating of articles arising out of differences in colour.

BRIEF DESCRIPTION OF THE DRAWINGS

There now follows a detailed description, to be read with reference to the accompanying drawings, of one apparatus and one method in accordance with the invention, said apparatus and method being hereinafter referred to as "the illustrative apparatus" and "the illustrative method". It will of course be appreciated that the illustrative apparatus and the illustrative method have been selected for description merely by way of exemplification of the invention and not by way of limitation thereof.

In the accompanying drawings.

DESCRIPTION OF THE PREFERRED EMBODIMENT

The illustrative apparatus is for use in the treatment of a lasted shoe the bottom of which has a coating of a moisture-curable composition by means of which, after curing, a shoe bottom unit may be secured, whether by injection moulding direct onto the shoe bottom or by bonding a pre-formed unit to the bottom. In the latter case, furthermore, by a simple modification to the article support of the apparatus, a coating of moisture-curable composition applied to such a unit may also be treated in the apparatus.

Figure 1:
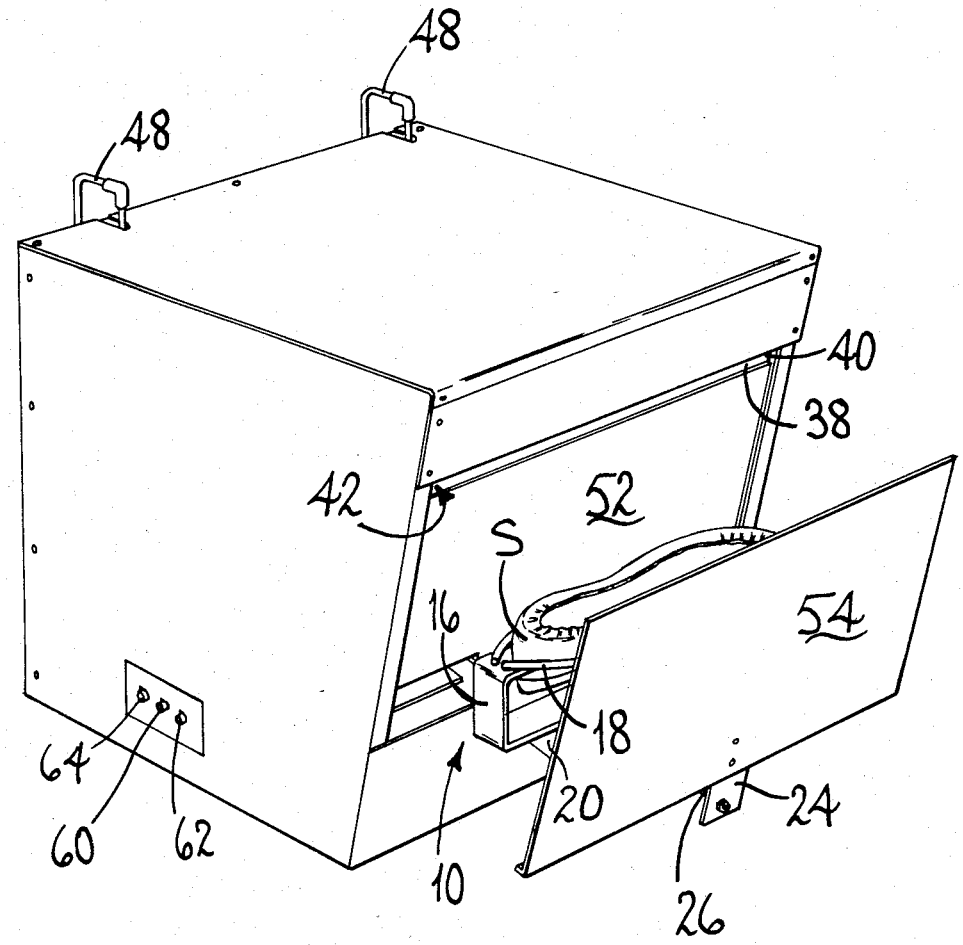
FIG. 1 is a perspective view of the illustrative apparatus, as showing an article support thereof in its loading-/unloading position.
Figure 2:
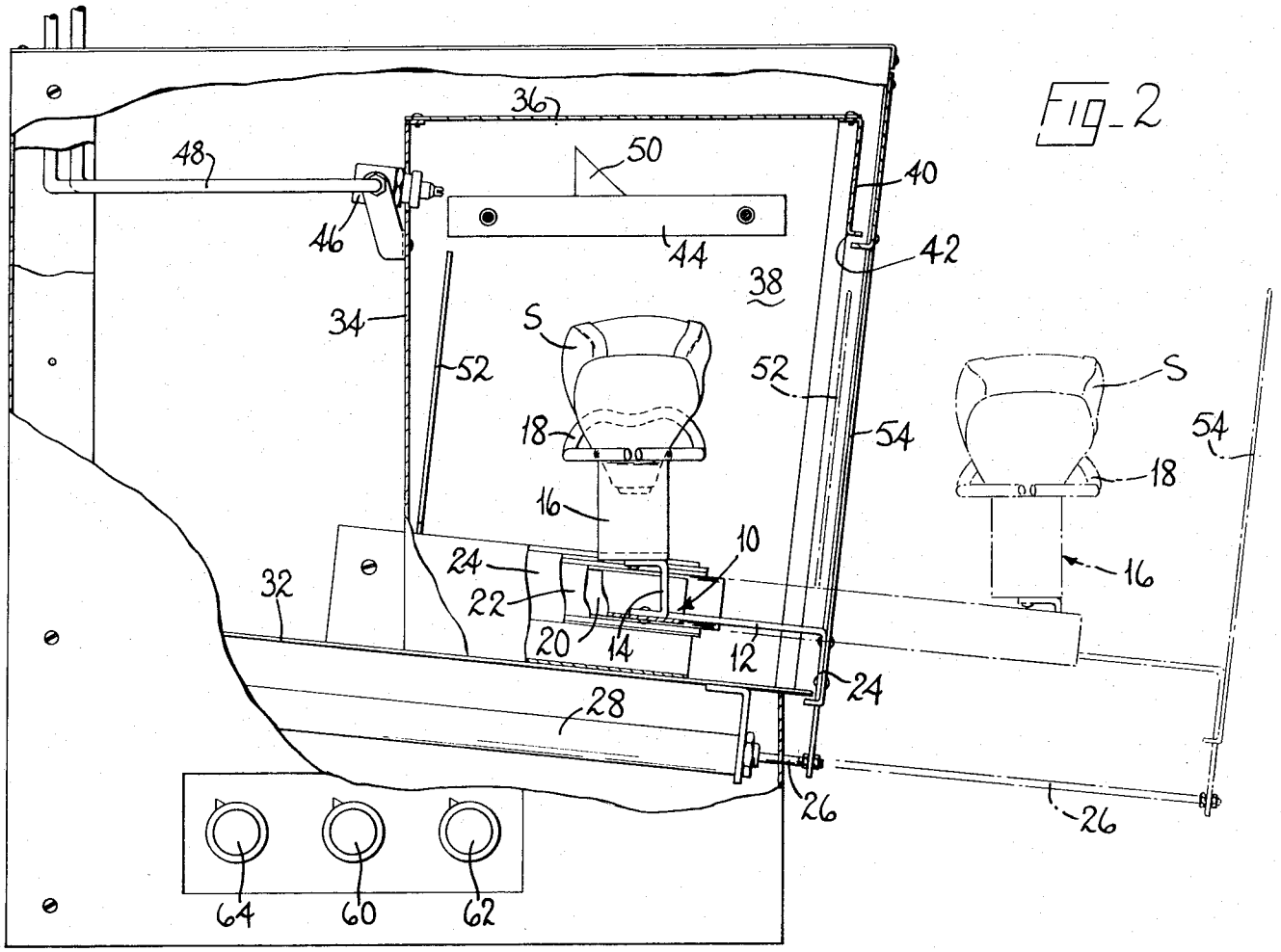
FIG. 2 is a side elevational view of the illustrative apparatus, with parts broken away, showing the support in its operative position.

The illustrative apparatus comprises a carriage generally designated 10, comprising an aluminium plate 12 and a bracket 14 extending upwardly therefrom, the bracket 14 carrying an article support 16 for a lasted shoe S. To this end, the support 16 comprises a bar 18 bent to a shape such that an inverted shoe S can be supported thereby. The plate 12 extends laterally of the apparatus and has upturned side portions 20, which are received in ball races 22 supported by a bracket 24. The ball races 22 extend fore-and-aft of the apparatus so that the carriage 10 can slide forwardly and rearwardly thereof. For thus moving the carriage, a piston-and-cylinder arrangement 28 has a piston rod 26 connected to a downwardly turned forward edge portion 24 of the plate 12, the arrangement 28 serving to move the carriage 10 between a loading/unloading position (shown in FIG. 1 and, in broken line, in FIG. 2) and an operative position (shown in full line in FIG. 2).

In its operative position, a lasted shoe S supported by the support 16 is substantially enclosed within a chamber 30 of the apparatus, said chamber being formed by a bottom plate 32, a rear plate 34, a top plate 36, two side plates 38 (one only shown in FIG. 2) and a front plate 40. All these plates are made of aluminium and are therefore good reflectors of infra-red radiation. The front plate 40 has a rectangular aperture 42 therein, through which the support 16, with a lasted shoe thereon, can pass as it is moved fore-and-aft as aforesaid. For effectively sealing the aperture 42 when the support 16 is moved to its operative position, a screen 54, also of aluminium, is mounted on the downwardly turned forward edge portion 24 of the plate 12 and extends upwardly therefrom, the dimensions of the screen 54 being somewhat larger than the aperture 42. Similarly, a further screen 52 is provided, mounted on a rearward portion of the plate 12, whereby the rectangular aperture 42 is closed when the support is in its loading/unloading position. The screen 52 is also of aluminium and is dimensioned somewhat larger than the aperture 42. By means of the two screens 52, 54 the chamber 30 is closed throughout a substantial part of any cycle operation of the illustrative apparatus.

The illustrative apparatus also comprises article treatment means for supplying heat and moisture to the chamber thus to treat an article supported therein, said article treatment means comprising a plate heater 44 supported within the chamber 30, above the operative position of the support 16, by brackets (not shown) carried by the side plates 38. The heater 44, by which an article supported on the support 16 is subjected to infra-red radiation, is in the form of an aluminium plate having a heating element embedded therein. Furthermore, the radiation surface of the heater 44 is blackened to increase its emissivity.

The article treatment means of the illustrative apparatus further comprises steam generating means by which steam can be supplied within the chamber 30, the steam generating means comprising a pair of mist-producing nozzles 46 mounted on a rear surface of the rear plate 34 and projecting through holes therein. The nozzles, which are connected by pipes 48 to a water supply, are directed towards the plate heater 44, more especially towards an upward projection 50 of triangular cross-section mounted on an upper surface of a heater. The projection 50 provides a vertical impingement surface for the water mist which serves to speedily convert the mist to steam while at the same time ensuring that the steam thus produced is uniformly distributed throughout the chamber 30.

It will be appreciated that, for a given dimension of nozzle, by controlling the pressure at which the water is supplied thereto, the amount of water supplied for a given time period, and thus the amount of steam generated as aforesaid, can be closely controlled.

To this end, the illustrative apparatus also comprises control means including a timer 60 for determining the period during which water is supplied through the nozzles 46 as aforesaid. In addition, the control means include a further timer 62 which control the operation of the piston-and-cylinder arrangement 28, so that the support 16 is withdrawn from the chamber after a controlled period therein. In addition, the control means comprises a temperature regulator 64 for controlling the intensity of the infra-red radiation, by sensing the temperature of the radiation surface of the heater 44.

In using the illustrative apparatus for curing a coating of a moisture-curing composition applied to a lasted shoe S (or shoe sole unit (not shown)), in carrying out the illustrative method, the humidity of the atmosphere within the chamber 30, within which the lasted shoe S is enclosed, is maintained at a dew point of between 50° and 60° C., care being taken to ensure that, by the end of the cycle of operation, the amount of steam within the atmosphere is not so great as to lead to problems of condensation of the steam upon the opening of the chamber to ambient atmosphere. To this end, the timer 60 should be set so that steam is supplied for a sufficient period to ensure that the desired humidity is maintained throughout the cycle of operation. It has been found in practice that, given that the dimensions of the nozzles 46 and the pressure of the water supply are sufficient to achieve a humidity of a dew point of the order of 60° C., then setting the time period for the steam supply in the order of 5 seconds is sufficient, bearing in mind that the chamber 30 is enclosed, for the humidity to be maintained at a dew point of between 50° and 60° C. during the remainder of the cycle of operation. Maintaining the humidity in the vicinity of a dew point of 60° C. has been found to be the optimum atmosphere for subjecting the shoe S to moisture without running the risk of damage to the shoe by staining due to condensation.

Whereas the moisture in the atmosphere is essential for the curing of the composition, the application of heat serves to increase the rate at which curing takes place. Since shoe uppers tend to be made of leather or of a polymeric material, it has been found that the optimum surface temperature for the heater is of the order of 380° C., if consideration is given merely to the speed of the cure. However, using a heater with a surface temperature of 380° C. has been found to cause the coating to form a skin which renders the coating less readily re-activatable at the normal re-activating temperatures, viz. of the order of 90° C. On the other hand, if the coating is to be used for bonding a directly moulded-on shoe bottom unit to the shoe bottom, then the temperatures at which the material of such shoe bottom unit can be moulded on, being significantly higher than 90° C., are sufficient to re-activate the cured coating and to achieve a satisfactory bond thereby. Thus, when the shoe is to have a unit moulded on direct, a temperature of 380° C. within the illustrative apparatus is acceptable.

Where, on the other hand, the coating is to be re-activated using a conventional activator unit, operating at temperatures in the order of 90° C., it has been found preferable to set the surface temperature of the heater 44 at a value lower than 380° C., preferably within the range 300° to 380° C. In this way, it has been found that the surface of the coating when cured is more readily reactivated by conventional activator units.

Nevertheless, for achieving satisfactory results bearing in mind the requirements of throughput of work, depending upon the time period during which the shoe remains in the illustrative apparatus, the surface temperature setting of between 250° and 420° C. has been found satisfactory.

The optimum time period for subjecting the shoe S to infra-red radiation has been calculated as being of the order of 10 seconds, in conditions where the humidity is maintained at a dew point of between 50° and 60° C. and the surface temperature of the heater 44 is of the order of 300° to 380° C. For a lower temperature, a time period of up to 25 seconds has been found to be acceptable, while for a higher temperature a time period of as little as 5 seconds has been found acceptable.

The heater 44 is of greater dimensions, both widthwise of the apparatus and fore-and-aft thereof, than the bottom of the lasted shoe S, so that the radiation falling on the shoe is substantially uniform over the surface of the bottom thereof, despite variations in the distance of the shoe bottom from the heater by virtue of the heightwise contour of the shoe bottom. Furthermore, as already mentioned, by the selection of a suitable band of wavelengths emitted by the heater 44 it can be ensured that the energy is strongly absorbed by the material of which the shoe upper is made, regardless of its colour, without the need to adjust the output of the heater 44. In addition, the manner in which the steam is distributed throughout the chamber also ensures that a substantially uniform moisture intake is achieved by the coating. In addition, because only tap water is supplied to the nozzles, problems arising from corrosion or hard water furring can be avoided. In addition, because all the internal surfaces of the chamber 30 and the surfaces of the screens 52, 54 constitute good reflectors of infra-red radiation, together with the facility of closing off the chamber whenever the support 16 is in either its loading/unloading position or its operative position, an efficient heating arrangement is afforded.

Having thus described our invention, what we claim as new and desire to secure as Letters Patent of the United States is:

1. Method of treating an article, e.g. a shoe part, having a coating of a moisture-curable composition, characterised in that the article is supported stationarily in an enclosed chamber for a period of between 5 and 25 seconds, during which period the article is subjected to infra-red radiation from a radiant source having a surface temperature of between 420° and 250° C. and a quantity of steam at ambient pressure is supplied to the chamber such that during said period the humidity of the atmosphere within the chamber is maintained at a dew point of between 50° and 60° C.

2. Method according to claim 1 characterised in that the period is of the order of 10 seconds, and the surface temperature of the radiant source is between 300° and 380° C.

3. Method according to claim 2 characterised in that steam is supplied to the chamber for a period of the order of 5 seconds starting comtemporaneously with the first-mentioned period.

4. Apparatus for the treatment of shoe parts, having a coating of a moisture curable composition, the apparatus comprising a support for an article to be treated, a chamber for receiving the support, and article treatment means for supplying heat and moisture to the chamber thus to treat an article supported therein, characterized in that, during the treatment of an article, the support is stationarily enclosed within the chamber, in that the article treatment means comprises means for subjecting each article to infra-red radiation and for supplying steam at ambient pressure within the chamber, and in that control means is provided for controlling—

(i) the amount of steam supplied in a cycle of operation;

(ii) the intensity of the infra-red radiation;

(iii) the time period during which the article is subjected to infra-red radiation; and (iv) the time period during which the steam is supplied.

5. Apparatus according to claim 4 wherein the support is movable between a loading/unloading position and an operative position, in which it is received within said chamber, characterised in that the support carries a screen by which, when the support is in its operative position, the chamber is closed.

6. Apparatus according to claim 5 characterised in that the support also carries a further screen by which, when the support is in its loading/unloading position, the chamber is also closed.

7. Apparatus according to claim 4 characterised in that the article treatment means comprises a plate heater, which is accommodated within the chamber and by which an article supported in the chamber is subjected to infra-red radiation, and spraying means whereby a mist of water can be sprayed on to the plate heater for the generation of steam within the chamber.

8. Apparatus according to claim 7 characterised in that the spraying means comprises one or more nozzles directed towards an impingement surface of the plate heater, impingement of the mist against said surface causing the mist to be converted to steam and such steam to be distributed throughout the chamber.

* * * * *